US005133904A

United States Patent [19]

Pepper

[11] Patent Number: 5,133,904

[45] Date of Patent: Jul. 28, 1992

[54] HUMIDIFIER

[75] Inventor: Kenneth V. Pepper, Plymouth, Wis.

[73] Assignee: Bemis Manufacturing Company, Sheboygan Falls, Wis.

[21] Appl. No.: 825,298

[22] Filed: Jan. 23, 1992

Related U.S. Application Data

[63] Continuation of Ser. No. 599,008, Oct. 17, 1990, abandoned.

[51] Int. Cl.[5] ..... B01F 3/04

[52] U.S. Cl. ..... 261/24; 261/99

[58] Field of Search ..... 261/24, 99, 107

[56] References Cited

U.S. PATENT DOCUMENTS

| | | | |
|---|---|---|---|
| 765,351 | 7/1904 | Avery et al. | 261/107 |
| 794,938 | 7/1905 | Houlon . | |
| 796,557 | 8/1905 | Bockoven . | |
| 1,058,808 | 4/1913 | Thilges | 261/99 |
| 1,272,275 | 7/1918 | Klein | 261/99 |
| 1,367,701 | 2/1921 | Haynes . | |
| 1,451,329 | 4/1922 | Dressler | 261/99 |
| 1,606,472 | 11/1926 | Kieffer et al. . | |
| 1,625,663 | 4/1927 | Kelly . | |
| 1,817,357 | 8/1931 | Fisher . | |
| 1,887,242 | 11/1932 | Martinson | 261/107 |
| 1,916,907 | 7/1933 | Sargent | 261/99 |
| 2,054,200 | 9/1936 | Langford | 219/39 |
| 2,104,209 | 1/1938 | Pierson | 261/107 |
| 2,307,938 | 1/1943 | Mathias | 261/99 |
| 2,474,746 | 6/1949 | Lopez et al | 261/99 |
| 2,669,319 | 2/1954 | Inglesby | 261/99 |
| 2,730,340 | 1/1956 | Patriarca | 261/26 |
| 2,749,725 | 6/1956 | Essman et al. | 62/131 |
| 2,800,306 | 7/1957 | Freeman | 257/3 |
| 2,906,512 | 9/1959 | Meek | 261/24 |
| 3,152,723 | 10/1964 | Perl et al. | 222/23 |
| 3,341,073 | 9/1967 | Arps et al. | 222/36 |
| 3,400,919 | 9/1968 | Schall | 261/102 |
| 3,409,219 | 11/1968 | Behnke | 237/78 |
| 3,465,915 | 9/1969 | De Harde | 222/66 |
| 3,598,370 | 8/1971 | Hoag | 261/26 |
| 3,619,988 | 11/1971 | Cornell | 261/99 |
| 3,621,834 | 11/1971 | Keuls | 55/234 |
| 3,637,194 | 1/1972 | Swimmer et al. | 261/29 |
| 3,757,494 | 9/1973 | Keuls | 55/234 |
| 3,811,661 | 5/1974 | Procter | 261/26 |
| 3,885,843 | 5/1975 | Rubel | 312/21 |
| 4,031,171 | 6/1977 | Asao et al. | 261/1 |
| 4,087,495 | 5/1978 | Umehara | 261/81 |
| 4,135,370 | 1/1979 | Hosoda et al. | 62/274 |
| 4,186,848 | 2/1980 | Walter | 222/23 |
| 4,216,176 | 8/1980 | Tanaka | 261/142 |
| 4,257,989 | 3/1981 | Nishikawa | 261/4 |
| 4,338,576 | 7/1982 | Takahashi et al. | 331/67 |
| 4,698,188 | 10/1987 | Gutmann | 261/107 |
| 4,712,713 | 12/1987 | Karlis et al. | 222/3 |
| 4,921,639 | 5/1990 | Chiu | 261/67 |

FOREIGN PATENT DOCUMENTS

| | | | |
|---|---|---|---|
| 2604169 | 8/1977 | Fed. Rep. of Germany | 261/107 |
| 759262 | 11/1933 | France | 261/99 |
| 0631134 | 7/1982 | Switzerland | 222/23 |

*Primary Examiner*—Tim Miles

*Attorney, Agent, or Firm*—Michael, Best & Friedrich

[57] ABSTRACT

A humidifier comprising a cabinet including a top wall having therein an air outlet, a bottom wall having therein an air inlet, and a water reservoir having portions on opposite sides of the air inlet, a wicking element including generally horizontally spaced-apart peripheral portions each located above a respective one of the reservoir portions, and also including a central portion located between the peripheral portions and above the inlet, material for transferring water from one of the reservoir portions to the respective peripheral portion of the wicking element and for transferring water from the other of the reservoir portions to the respective peripheral portion of the wicking element, and a fan supported by the cabinet and located above the wicking element for forcing air flow in a substantially vertical direction through the inlet and the central portion of the wicking element and out the outlet.

15 Claims, 2 Drawing Sheets

HUMIDIFIER

This is a continuation of application Ser. No. 07/599,008, filed Oct. 17, 1990, now abandoned.

BACKGROUND OF THE INVENTION

1. Field of the Invention

This invention relates to humidifiers, and more particularly to evaporative home humidifiers.

2. Description of the Prior Art

A conventional home humidifier includes a reservoir or tank of water through which is passed an endless belt fabricated of an air permeable medium such as reticulated polyurethane foam. Air blown through the portion of the belt that is not in the water evaporates water from the belt and transfers the water to the atmosphere as a vapor.

Another known humidifier includes a reservoir or tank of water and a wicking element that is supported in the water on floats so that only the lower end of the wicking element is immersed in the water. The wicking element moves downwardly relative to the reservoir as the water level falls. Air blown through the wicking element evaporates water from the wicking element and transfers water to the atmosphere.

SUMMARY OF THE INVENTION

The invention provides a humidifier utilizing a stationary wicking element. The wicking element has a honeycomb or other suitable form and sits with only its bottom edge immersed in a trough of water. Wicking action causes the water to saturate the wicking element, and air is passed through the wicking element in order to transfer water vapor to the atmosphere.

It is believed that capillary attraction is the force that causes the water to be drawn up to saturate the wicking element. Accordingly, the present invention places the wicking element into the trough of water at an angle to reduce the effect of gravity which opposes the transfer of water up the wicking element by capillary attraction. Placing the wicking element into the trough of water at an angle allows the wicking element to become wetter at its uppermost point than conventional wicking elements which are placed vertically into the trough of water. This more uniform wetting of the wicking element provides an increased water evaporation rate as compared to conventional vertical wicking elements. It has been discovered that by angling a wicking element which was previously vertical and extending ten inches above the water to a height of eight inches above the water will increase the water evaporation rate by approximately twenty percent.

The humidifier further comprises a fan or blower for transferring water from the wicking element to the atmosphere. This fan or blower pulls air through the wicking element and increases the evaporation of water from the wicking element.

Other features and advantages of the invention will become apparent to those skilled in the art upon review of the following detailed description, claims and drawings.

Figure 1:
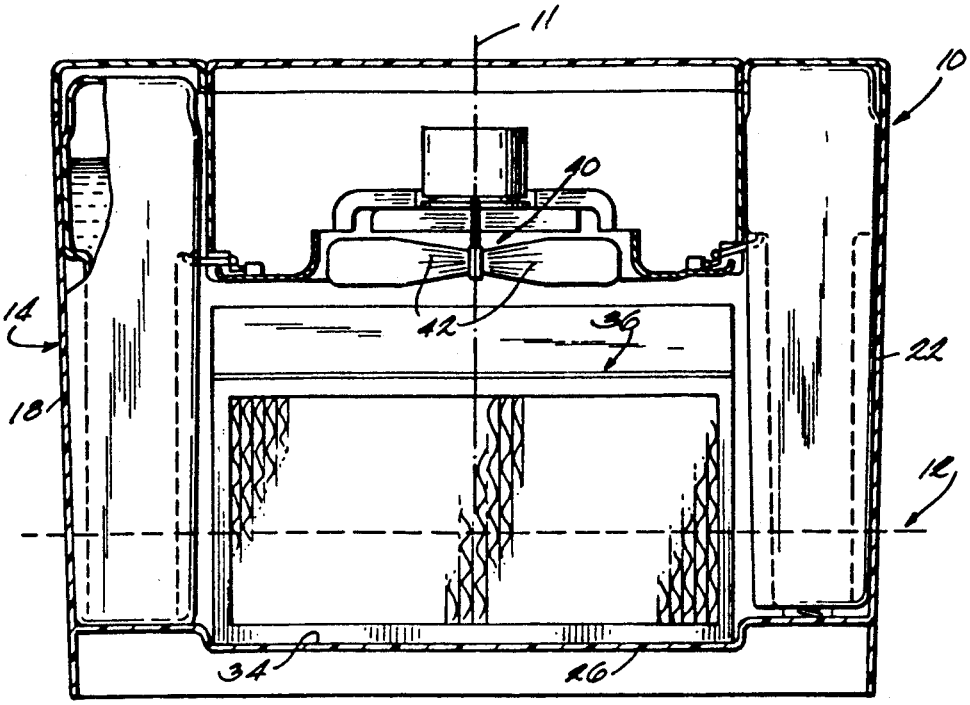
FIG. 1 is a rear elevational view, partially in section, of a humidifier embodying the invention.

Before one embodiment of the invention is to be explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A humidifier 10 embodying the invention is illustrated in FIGS. 1–4. Except as described below, the humidifier 10 is substantially identical to the humidifier described in U.S. Ser. No. 512,889, filed Apr. 23, 1990, which is assigned to the assignee hereof, and which is herein incorporated by reference. The humidifier 10 has a vertical axis 11 and is intersected by a horizontal plane 12. The humidifier 10 comprises a cabinet 14 having opposite right and left side walls 18 and 22 and a bottom wall 26 and a rear wall 30 extending between the side walls 18 and 22. The rear wall 30 has therein (see FIG. 3) an air inlet 32. A filter 33 is mounted on the rear wall 30 over the inlet 32. The bottom wall 26 defines a trough or water reservoir 34 located adjacent to the air inlet 32 and adapted to contain water. The trough 34 is elongated in the direction extending between the side walls 18 and 22.

Figure 3:
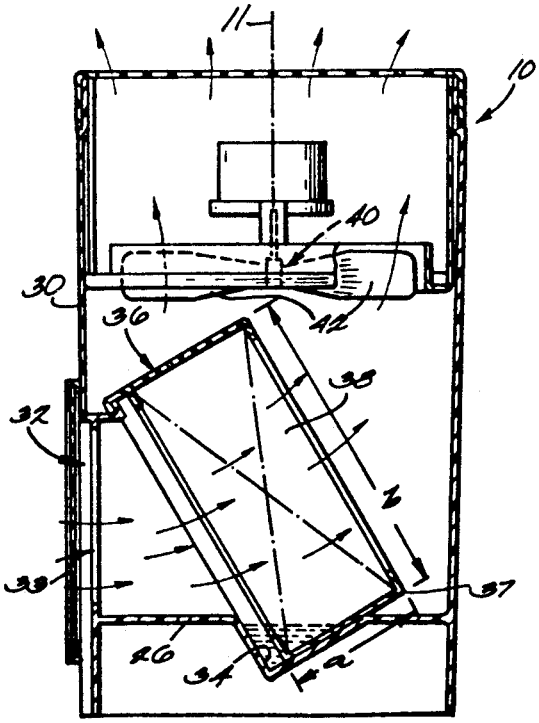
FIG. 3 is a vertical sectional view of the humidifier.
Figure 2:
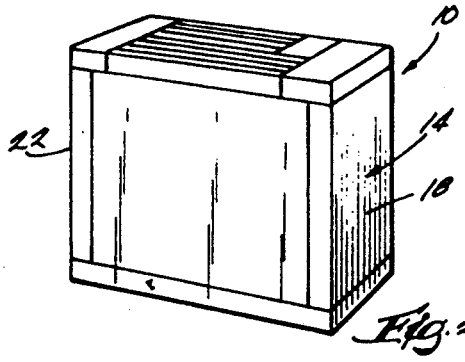
FIG. 2 is a front perspective view of the humidifier.
Figure 4:
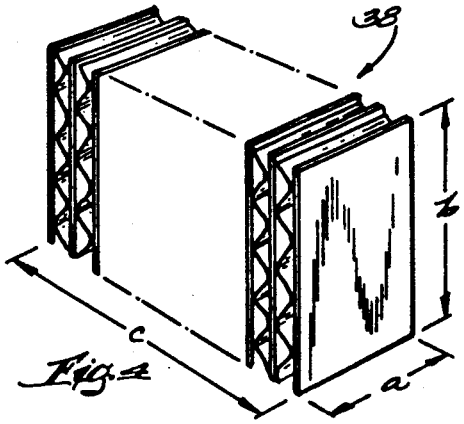
FIG. 4 is a partial perspective view of a wicking element.

The humidifier 10 also comprises a wicking assembly 36 including a frame 37 supporting a wicking element 38. The wicking element 38 extends transversely relative to the vertical axis 11 and has a lower portion in fluid communication with the water reservoir 34. Preferably, as shown in FIG. 3, the wicking element 38 has its lower portion in the water reservoir 34. The wicking element 38 can have any suitable construction and can be formed of any suitable material. However, the wicking element 38 is preferably constructed in a "honeycomb" form and is preferably formed of a high density nonwoven cellulosic material. The wicking element 38 has (see FIGS. 3 and 4) a minor dimension "a" extending transversely to the horizontal plane 12, a first major dimension "b" which is greater than the minor dimension "a" and which extends perpendicularly to the minor dimension "a", and a second major dimension "c" which is greater than the minor dimension "a" and which extends perpendicularly to the first major dimension "b" and to the minor dimension "a". Preferably, the minor dimension "a" extends at an angle of approximately 30 degrees relative to the plane 12, and the major dimension "b" extends at an angle of approximately 120 degrees relative to the vertical axis 11.

The humidifier 10 also comprises means for transferring water from the wicking element 38 to the atmosphere. This means preferably includes fan means for forcing air flow in a non-horizontal direction, i.e. in the direction of the minor dimension "a", through the wicking element 38. Although any suitable fan means can be employed, the fan means preferably includes an electric fan 40 having a plurality of fan blades 42 supported within the cabinet 14. The fan 40 draws air through the wicking element 38. The air then passes out of the humidifier 10 and transfers water vapor to the atmosphere.

It is believed that capillary attraction is the force that causes water to be drawn up from the water reservoir 34 to saturate the wicking element 38. Thus, gravity is a counterforce that resists the vertical transfer of water by capillary attraction. The advantage of using an angled or horizontal wicking element rather than a vertical wicking element is that the angled or horizontal wicking element becomes more uniformly saturated with water throughout its entire height than the vertical wicking element. This more uniform saturation of the wicking element provides an increase in the evaporation rate of the water as compared to humidifiers utilizing a vertical wicking element.

In humidifiers utilizing vertical wicking elements, the area of the wicking element immediately above the water level in the water reservoir and for approximately two to three inches above this level is truly saturated. However, at the level ten inches above the water level, the wicking element is merely moist. Experimental work has shown that approximately ten inches above the water level is the greatest height that capillary attraction can elevate water from the water reservoir. Thus, it appears that at ten inches above the water level, the force of gravity exceeds the capillary attraction of the wicking element and there is thereafter only negligible water transfer.

By placing the wicking element at an angle or horizontally, a wicking element of the same or greater "height" as a vertical element can be used while at the same time lowering the uppermost part of the wicking element in relation to the surface of the water in the water reservoir. This will allow the wicking element to become wetter at its uppermost part. If the wicking element is placed into the water reservoir such that its uppermost part is less than four inches above the water level in the water reservoir, the entire wicking element will be saturated with water.

Figure 5:
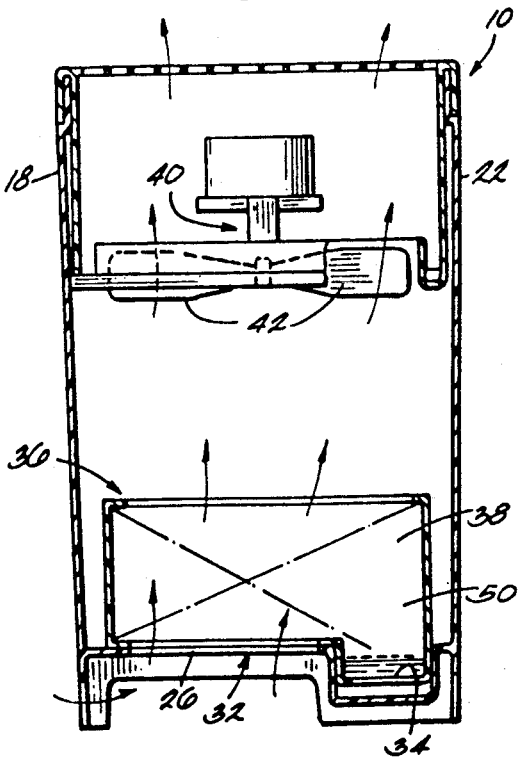
FIG. 5 is a sectional view of an alternative embodiment of the invention.

An alternative embodiment of the invention is shown in FIG. 5. In this alternative embodiment, the wicking element 38 extends generally perpendicularly to the vertical axis 11. In other words, the major dimensions of the wicking element 38 extend perpendicularly to the axis 11. The wicking element 38 is L-shaped and has a lower portion located in the reservoir 34. The air inlet 32 is located in the bottom wall 26. The fan 40 forces vertical air flow through the wicking element 38.

Figure 6:
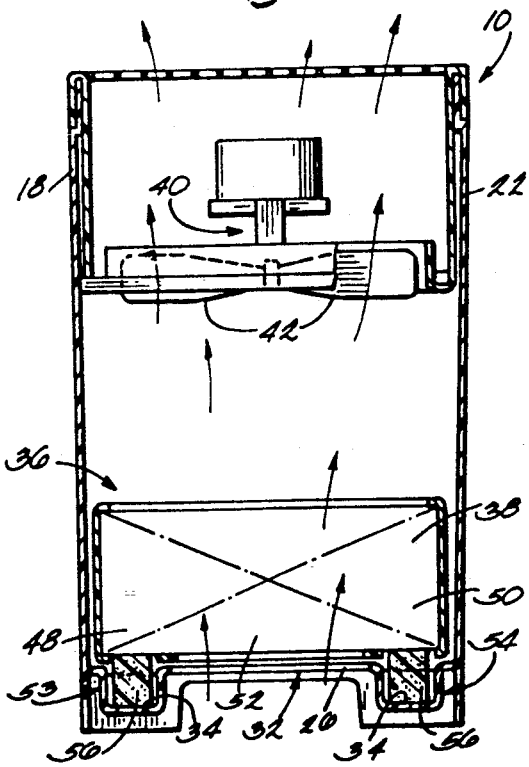
FIG. 6 is a sectional view of a second alternative embodiment of the invention.

A second alternative embodiment is shown in FIG. 6. In this embodiment, the wicking element 38 extends generally perpendicularly to the vertical axis 11. The wicking element 38 includes generally horizontally spaced-apart peripheral portions 48 and 50, and a central portion 52 located between the peripheral portions 48 and 50. The reservoir 34 includes spaced apart portions 53 and 54, and the peripheral portions 48 and 50 are seated on respective means, such as a wettable sponge-like material 56, located in the portions 53 and 54 of the water reservoir 34 for transferring water from the water reservoir 34 to the peripheral portions 48 and 50 of the wicking element 38. The air inlet 32 is located in the bottom wall 26 beneath the central portion 52 of the wicking element 38. The fan means forces substantially vertical air flow through the central portion of the wicking element 38.

Various features of the invention are set forth in the following claims.

I claim:

1. A humidifier having a vertical axis and comprising a water reservoir having an upwardly facing bottom surface, a wicking element extending transversely relative to said vertical axis and having a portion in fluid communication with said water reservoir, means located in said water reservoir for transferring water from said water reservoir to said portion of said wicking element to provide fluid communication between said wicking element and said water reservoir, said transferring means including a piece of wettable material which is separate from said wicking element, which is seated in said water reservoir, which is supported by said bottom surface of said reservoir, and on which said portion of said wicking element is supported, and means for forcing air flow through said wicking element.

2. A humidifier as set forth in claim 1 wherein said wicking element extends generally perpendicularly to said vertical axis.

3. A humidifier as set forth in claim 1 wherein said wicking element is comprised of a high density cellulosic material.

4. A humidifier as set forth in claim 1 wherein said wicking element includes horizontally spaced-apart peripheral portions in fluid communication with said water reservoir, wherein said wicking element also includes a central portion between said peripheral portions, wherein said means forces air flow through said central portion of said wicking element, wherein one of said peripheral portions is seated on said first mentioned piece of wettable material, and wherein the other of said peripheral portions is seated on a second piece of wettable material which is separate from said wicking element and which is seated in said water reservoir.

5. A humidifier as set forth in claim 1 wherein said wicking element is made of a different material from said wettable material.

6. A humidifier as set forth in claim 1 wherein said humidifier is intersected by a horizontal plane, and wherein said wicking element has a minor dimension extending transversely to said horizontal plane.

7. A humidifier as set forth in claim 6 wherein said wicking element has a first major dimension which is greater than said minor dimension and which extends generally perpendicularly to said minor dimension, and a second major dimension which is greater than said minor dimension and which extends generally perpendicularly to said first major dimension and to said minor dimension.

8. A humidifier as set forth in claim 7 wherein said forcing means causes air flow through said wicking element in the direction of said minor dimension.

9. A humidifier comprising a water reservoir, a wicking element including a portion in fluid communication with said water reservoir such that water moves by capillary attraction from said reservoir to said element, said wicking element being a rectangular solid with no integral projections and with substantially horizontal, substantially planar, spaced-apart, upper and lower surfaces, substantially vertical, substantially planar, substantially parallel first and second side surfaces, and substantially vertical, substantially planar, substantially parallel third and fourth side surfaces extending substantially perpendicular to said first and second side surfaces, the distance between said first and second surfaces and the distance between said third and fourth surfaces being greater than the distance between said upper and lower surfaces, and means for forcing air flow in a generally vertical direction through said wicking element.

10. A humidifier as set forth in claim 9 wherein said wicking element includes horizontally spaced-apart peripheral portions in fluid communication with said water reservoir, wherein said wicking element also includes a central portion between said peripheral portions, and wherein said means forces air flow through said central portion of said wicking element.

11. A humidifier as set forth in claim 9 wherein said wicking element is comprised of a high density cellulosic material.

12. A humidifier as set forth in claim 9 and further comprising means located in said water reservoir for transferring water from said water reservoir to said portion of said wicking element to provide fluid communication between said wicking element and said water reservoir.

13. A humidifier as set forth in claim 12 wherein said transferring means includes wettable material which is seated in said water reservoir and on which said portion of said wicking element is seated.

14. A humidifier comprising a cabinet including a top wall having therein an air outlet, a bottom wall having therein an air inlet, and a water reservoir having portions on opposite sides of said air inlet, a wicking element including generally horizontally spaced-apart peripheral portions each located above a respective one of said reservoir portions, and also including a central portion located between said peripheral portions and above said inlet, said wicking element being a rectangular solid with substantially horizontal, spaced-apart, planar upper and lower surfaces, substantially vertical, planar, parallel first and second side surfaces, and substantially vertical, planar, parallel third and fourth side surfaces extending substantially perpendicular to said first and second side surfaces, the distance between said first and second surfaces and the distance between said third and fourth surfaces being greater than the distance between said upper and lower surfaces, means for transferring water from one of said reservoir portions to the respective peripheral portion of said wicking element and for transferring water from the other of said reservoir portions to the respective peripheral portion of said wicking element, said means for transferring water from said reservoir portions to said wicking element including a first piece of wettable material which is separate from said wicking element, which is seated in one of said reservoir portions, and on which the respective peripheral portion of said wicking element is supported, and a second piece of wettable material which is separate from said wicking element, which is seated in the other of said reservoir portions, and on which the respective peripheral portion of said wicking element is supported, and a fan supported by said cabinet and located above said wicking element for forcing air flow in a substantially vertical direction through said inlet and said central portion of said wicking element and out said outlet.

15. A humidifier as set forth in claim 14 wherein said wicking elements is comprised of a high density cellulosic material.

* * * * *